US010847920B2

(12) United States Patent
Pan

(10) Patent No.: US 10,847,920 B2
(45) Date of Patent: Nov. 24, 2020

(54) STRAIGHT THROUGH TYPE CONNECTOR CAPABLE OF REPEATEDLY PULLING CAPS AT BOTH ENDS

(71) Applicant: FOSHAN OJUN ELECTRONIC CO., LTD., Foshan (CN)

(72) Inventor: Changxiong Pan, Foshan (CN)

( * ) Notice: Subject to any disclaimer, the term of this patent is extended or adjusted under 35 U.S.C. 154(b) by 0 days.

(21) Appl. No.: 16/510,836

(22) Filed: Jul. 12, 2019

(65) Prior Publication Data

US 2020/0313338 A1 Oct. 1, 2020

(30) Foreign Application Priority Data

Mar. 30, 2019 (CN) ..... 2019 1 0253926

(51) Int. Cl.
*H01R 12/00* (2006.01)
*H01R 13/502* (2006.01)
*H01R 13/631* (2006.01)

(52) U.S. Cl.
CPC ..... *H01R 13/502* (2013.01); *H01R 13/6315* (2013.01)

(58) Field of Classification Search
CPC ..... H01R 13/502; H01R 13/5025; H01R 13/6315
USPC ..... 439/76.1, 76.2
See application file for complete search history.

(56) References Cited

U.S. PATENT DOCUMENTS

| | | | | |
|---|---|---|---|---|
| 4,687,267 | A * | 8/1987 | Header | H01R 12/725 439/607.07 |
| 6,065,978 | A * | 5/2000 | Dehan | H01R 13/405 439/79 |
| 6,155,843 | A * | 12/2000 | Tung | H01R 12/725 439/64 |
| 6,358,067 | B1 * | 3/2002 | Takase | H01R 12/716 439/541.5 |
| 6,860,744 | B2 | 3/2005 | Maruyama et al. | |
| 7,175,475 | B2 * | 2/2007 | Hanley | H01R 13/6584 439/607.19 |
| 2017/0212308 | A1 | 7/2017 | Koch | |
| 2018/0040983 | A1 | 2/2018 | Matsumoto et al. | |

FOREIGN PATENT DOCUMENTS

| | | |
|---|---|---|
| CN | 205141191 U | 4/2016 |
| CN | 207977554 U | 10/2018 |
| CN | 209001163 U | 6/2019 |

* cited by examiner

*Primary Examiner* — Khiem M Nguyen
(74) *Attorney, Agent, or Firm* — Erson IP (Nelson IP)

(57) ABSTRACT

A straight through type connector capable of repeatedly pulling caps at both ends, including a first shell having a first jack hole, a middle body, a second shell having a second jack hole, a conductor, two elastic pieces and two flip caps. The middle body is arranged between the first shell and the second shell and the first shell, the two flip caps are in one-to-one correspondence and are respectively rotatably arranged in the first shell and the second shell, the conductor penetrates through the middle body and is fixed relative to the middle body, the conductor is located above the two elastic pieces and respectively form a holding space for holding wires, one of the two elastic pieces is arranged in the first shell, the other elastic piece is arranged in the second shell. The connector can be firmly connected with the wires, avoiding bad contact.

9 Claims, 5 Drawing Sheets

STRAIGHT THROUGH TYPE CONNECTOR CAPABLE OF REPEATEDLY PULLING CAPS AT BOTH ENDS

CROSS-REFERENCE TO RELATED APPLICATIONS

This application claims priority to Chinese Patent Application No. 201910253926.4 with a filing date of Mar. 30, 2019. The content of the aforementioned applications, including any intervening amendments thereto, are incorporated herein by reference.

TECHNICAL FIELD

The disclosure relates to the field of connectors, and particularly relates to a straight through type connector capable of repeatedly pulling caps at both ends.

BACKGROUND OF THE PRESENT INVENTION

In the related techniques, a connector has the problems that fixation of a wire is unstable, easy to loosen and difficult to assemble and disassemble when the wires is connected, needs secondary abutting by humans, and even a problem of bad contact is caused by falling.

SUMMARY OF PRESENT INVENTION

The object of the disclosure is to provide a straight through type connector capable of repeatedly pulling caps at both ends to solve the above technical problem.

Embodiments of the disclosure are achieved as follows: provided is a straight through type connector capable of repeatedly pulling caps at both ends, comprising a first shell having a first jack hole, a middle body, a second shell having a second jack hole, a conductor, two elastic pieces and two flip caps, wherein, the middle body is arranged between the first shell and the second shell and the first shell can be detachably abutted with the second shell, the two flip caps are in one-to-one correspondence and are respectively rotatably arranged in the first shell and the second shell, the conductor penetrates through the middle body and is fixed relative to the middle body, one end of the conductor extends toward the first shell, the other end of the conductor extends toward the second shell, the conductor is located above the two elastic pieces and respectively form a holding space for holding wires together with the two elastic pieces, one of the two elastic pieces is arranged in the first shell and driven by one of the flip caps to be close to or far away from the conductor, the other elastic piece is arranged in the second shell and driven by the other flip cap to be close to or far away from the conductor.

Optionally, the bottom side of the conductor is provided with grooves, at least partial elastic pieces upwardly extend into the grooves to compress at least partial wires in the grooves.

Optionally, the elastic piece comprises a V-shaped body, one side of the body is compressed in the inner bottom surface of the first shell or the second shell, the body is provided with two opposite connection arms and an extension portion located between the two opposite connection arms, the connection arms are abutted against the flip caps, the extension portion is matched with the grooves to compress the at least partial wires into the grooves through the extension portion.

Optionally, the vertical cross section of the groove is of a trapezoid shape.

Optionally, the first shell is provided with a first fixation plate extending toward the second shell, the first fixation plate is provided with a first clamp portion, the second shell is provided with a second fixation plate extending toward the first shell, the second fixation plate is provided with a second clamp portion, the top of the middle body is respectively provided with a first clamp hole matched with the first clamp portion and a second clamp hole matched with the second clamp portion.

Optionally, the first clamp portion and the second clamp portion both comprise inclined surfaces, and from top to bottom, the distance between the inclined surface of the first clamp portion and the inclined surface of the second clamp portion is gradually reduced.

Optionally, the two sides of the middle body are respectively provided with slots, the first fixation plate is inserted into one of the slots, and the second fixation plate is inserted into the other slot.

Optionally, the bottom of the middle body is also provided with the first clamp hole and the second clamp hole, the bottom side of the first shell is also provided with the first clamp portion, the bottom side of the second shell is also provided with the second clamp portion.

Optionally, limit grooves are respectively formed in the first shell and the second shell, the limit grooves extend in a horizontal direction, and at least partial elastic pieces are clamped in the limit grooves.

The embodiments of the disclosure have the beneficial effects that since the conductor is fixed relative to the middle body, and a holding space for holding the wires is formed between the conductor and the elastic piece, and meanwhile, the elastic piece is driven by the flip cap to be close to or far away from the conductor. Thus, when the relative fixation of the flip cap is maintained, the holding space formed between the elastic piece and the conductor is extremely stable so that the wire held therein is difficulty disengaged between the elastic piece and the conductor, thereby facilitating the improvement of connection stability of the wires and avoiding a problem of bad contact.

DESCRIPTION OF THE DRAWINGS

In order to make the technical solutions in the disclosure or in the prior art described more clearly, the drawings associated to the description of the embodiments or the prior art will be illustrated concisely hereinafter. Obviously, the drawings described below are only some embodiments according to the disclosure. Numerous drawings therein will be apparent to one of ordinary skill in the art based on the drawings described in the disclosure without creative efforts.

Figure 1:
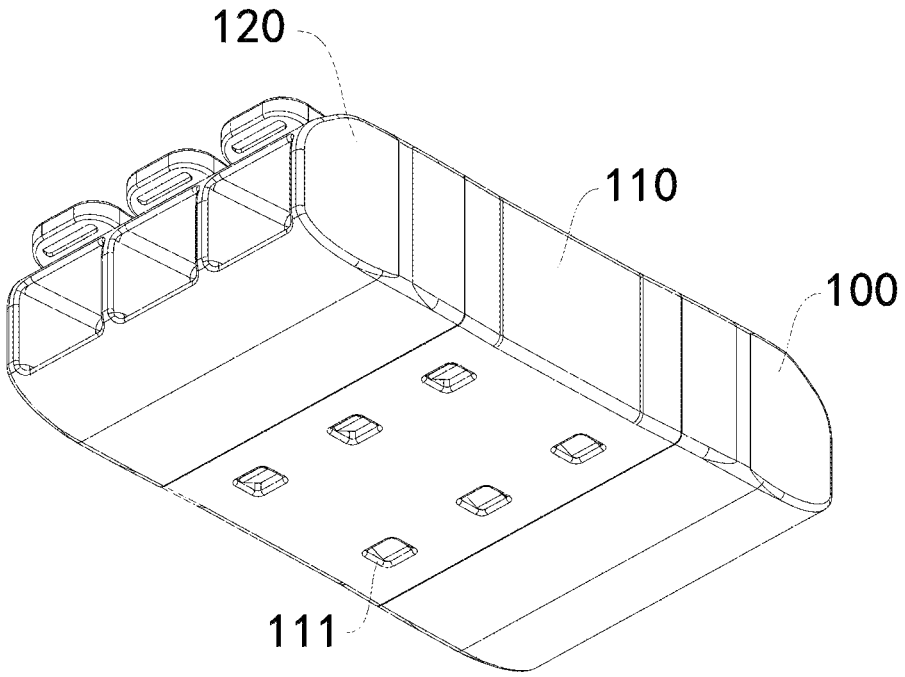
FIG. 1 is a straight through type connector capable of repeatedly pulling caps at both ends according to an embodiment of the disclosure.

Reference numbers: 100—first shell; 101—first jack hole; 102—first fixation plate; 110—middle body, 111—first clamp hole; 112—second clamp hole; 113—slot; 120—second shell; 121—second jack hole; 122—second fixation hole; 123—limit groove; 130—conductor; 131—groove; 140—elastic piece; 141—body, 142—connection arm; 143—extension portion; 150—flip cap; 1021—first clamp portion; 1221—second clamp portion

DETAILED DESCRIPTION OF PREFERRED EMBODIMENTS

In order to make the objects, technical solution and advantages of the embodiments of the disclosure more clear, the technical solutions in the embodiments of the disclosure will be clearly and completely described with reference to the accompanying drawings in embodiments of the disclosure, apparently, the described embodiments are only some parts of embodiments but not all the embodiments. Typically, assemblies of the embodiments of the disclosure described and shown in the drawings here can be arranged and designed in various configurations.

Hence, the detailed descriptions of the embodiments of the disclosure provided in the drawing are not intended to limit the protection scope of the disclosure, but only represent selected embodiments of the disclosure. Based on the embodiments of the disclosure, other embodiments obtained by those of ordinary skill in the art without any creative efforts are all included within the protection scope of the disclosure.

Figure 2:
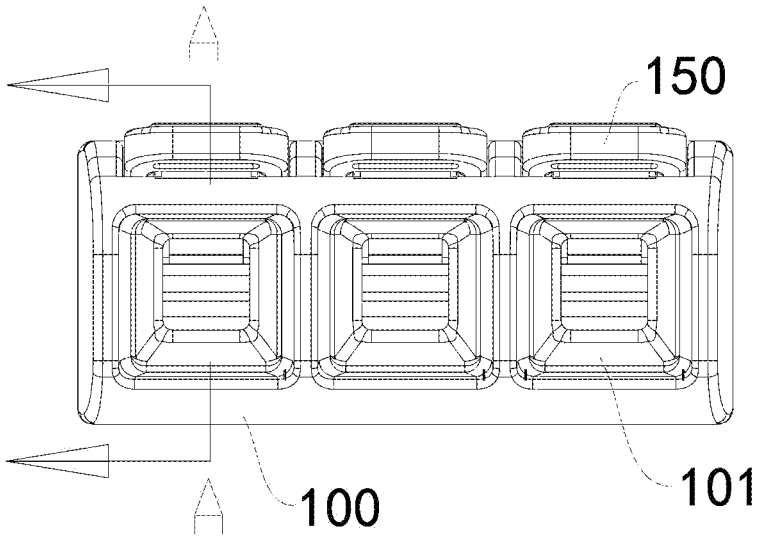
FIG. 2 is a structural diagram of FIG. 1 from another view.
Figure 3:
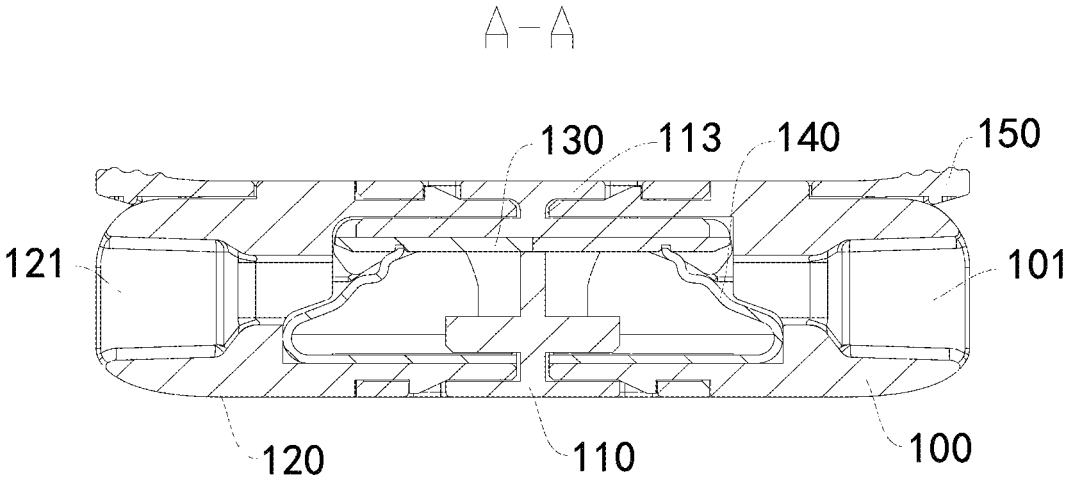
FIG. 3 is a sectional view taken along A-A in FIG. 2.

Referring to FIG. 1, FIG. 2 and FIG. 3, an embodiment of the disclosure provides a straight through type connector capable of repeatedly pulling caps at both ends. The straight through type connector capable of repeatedly pulling caps at both ends comprises a first shell 100 having a first jack hole 101, a middle body 110, a second shell 120 having a second jack hole 121, a conductor 130, two elastic pieces 140 and two flip caps 150.

The first shell 100, the middle body 110 and the second shell 120 are all of a through type structure. In other words, the first shell 100, the second shell 120 and the middle body 110 are configured as a "straight-line"—shaped structure, the first jack hole 101 of the first shell 100 and the second jack hole 121 of the second shell 120 both extend in the length direction of the connector, in such a way, the wire can respectively extend toward the direction of the middle body 110 from the first jack hole 101 of the first shell 100, and the second jack hole 121 of the second shell 120 extends to the direction of the middle body 110 from the second jack hole 121 of the second shell 120.

Figure 4:
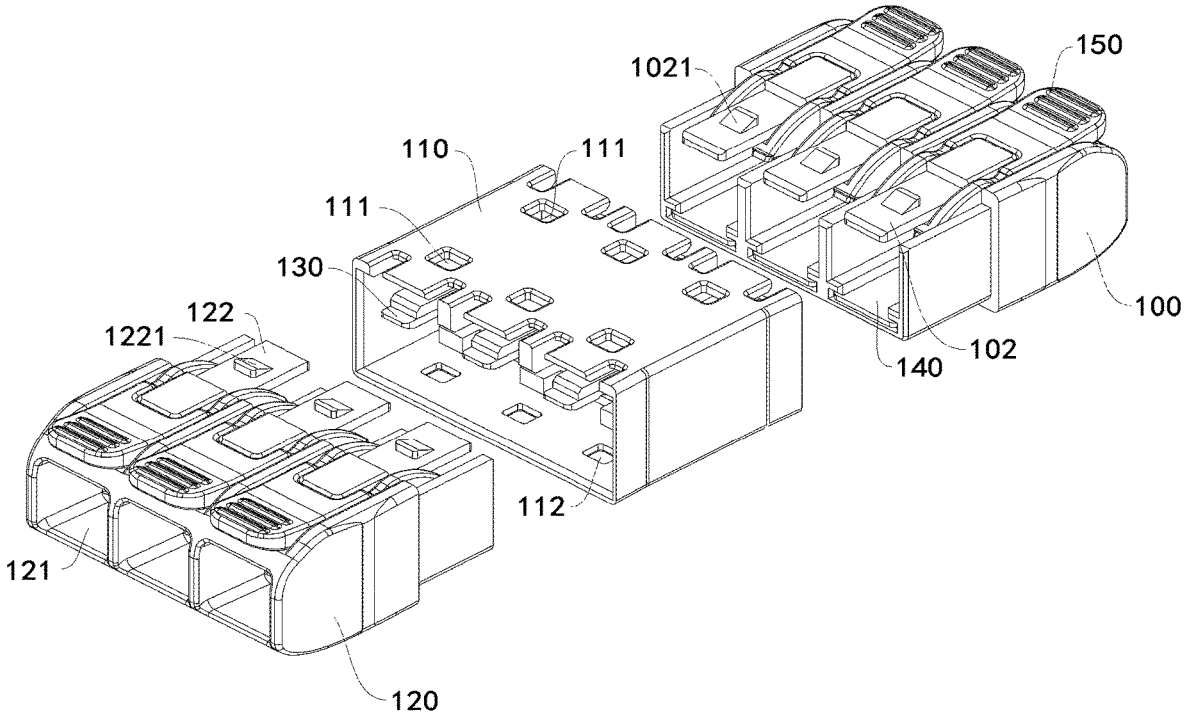
FIG. 4 is an exploded view of a straight through type connector capable of repeatedly pulling caps at both ends according to an embodiment of the disclosure.

Referring to FIG. 3 and FIG. 4, the middle body 110 is arranged between the first shell 100 and the second shell 120 and the first shell 100 can be detachably abutted with the second shell 120, the conductor penetrates through the middle body 110 and is fixed relative to the middle body 110, one end of the conductor 130 extends toward the first shell 100, the other end of the conductor 130 extends toward the second shell 120, the two flip caps 150 are in one-to-one correspondence and are respectively rotatably arranged in the first shell 100 and the second shell 120, the conductor 130 is located above the two elastic pieces 140 and respectively form a holding space for holding wires together with the two elastic pieces 140, one of the two elastic pieces 140 is arranged in the first shell 100 and driven by one of the flip caps 150 to be close to or far away from the conductor 130, the other elastic piece 140 is arranged in the second shell 120 and driven by the other flip cap 150 to be close to or far away from the conductor 130.

Through the above technical solution, since the conductor 130 is fixed relative to the middle body 110, and the holding space for holding the wires is formed between the conductor 130 and the elastic piece 140, and meanwhile, the elastic piece 140 is driven by the flip cap 150 to be close to or far away from the conductor 130. Thus, when the relative fixation of the flip cap 150 is maintained, the holding space formed between the elastic piece 140 and the conductor 130 is extremely stable so that the wire held therein is difficulty disengaged between the elastic piece 140 and the conductor 130, thereby facilitating the improvement of connection stability of the wires and avoiding the problem of bad contact.

Through arrangement of the two flip caps 150 and the two elastic pieces 140, wires can be compressed from two ends of the connector, and the flip caps 150 can be repeatedly overturned. It is noted that this connector can be compatible with soft and hard wires of 4 squares and 0.2 square.

Figure 5:
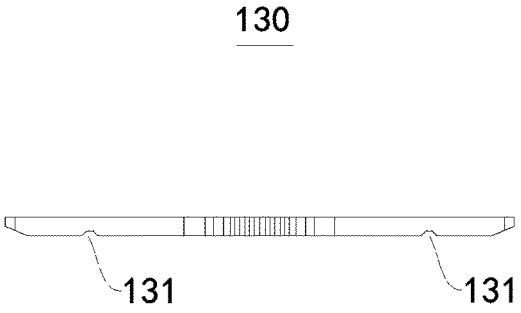
FIG. 5 is a structural diagram of a conductor according to an embodiment of the disclosure.
Figure 6:
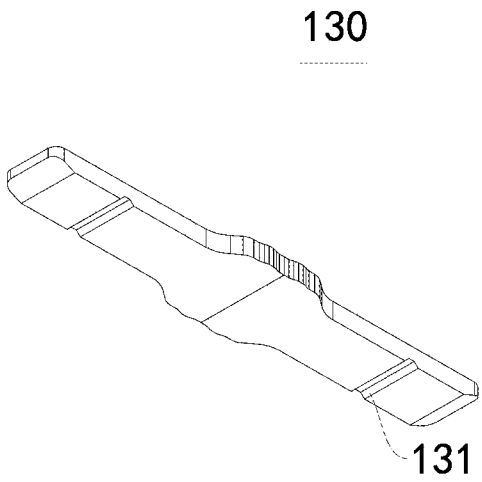
FIG. 6 is a structural diagram of FIG. 5 from another view.
Figure 7:
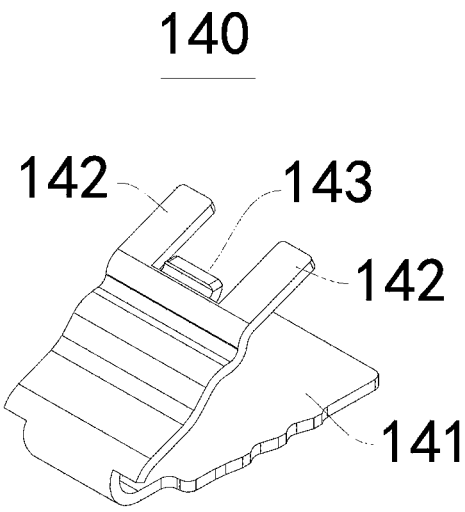
FIG. 7 is a structural diagram of an elastic piece according to an embodiment of the disclosure.
Figure 8:
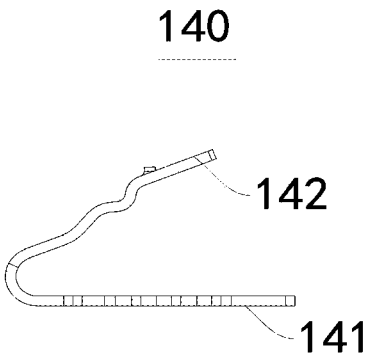
FIG. 8 is a structural diagram of FIG. 7 from another view.
Figure 9:
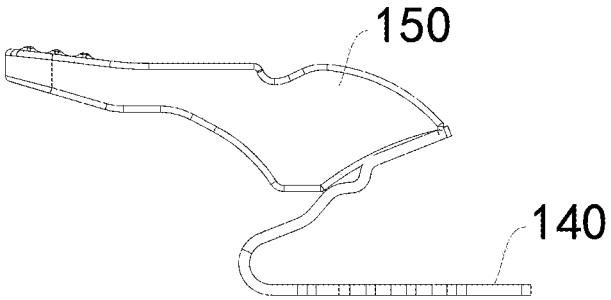
FIG. 9 is structural diagrams of a flip cap and an elastic piece according to an embodiment of the disclosure.
Figure 10:
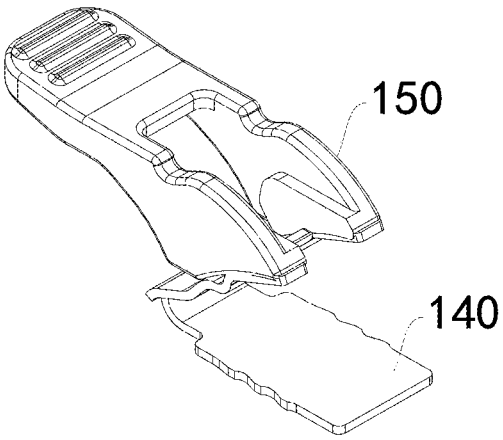
FIG. 10 is a structural diagram of FIG. 9 from another view.

Referring to FIG. 5 and FIG. 6, in this embodiment, the conductor 130 is configured as a platy structure, the bottom side of the conductor 130 is provided with a groove 131, at least partial elastic pieces 140 upwardly extend into the grooves 131 to compress at least partial wires in the groove 131. By compressing the at least partial wires into the grooves 131, the connection stability of the wire can be enhanced. Further, the cross section of the groove 131 is provided as a trapezoid shape, it is understood that when the cross section shape of the groove 131 is of the trapezoid shape and the wire is compressed in the groove 131, the corner angles but not smooth arc shape will be generated at the periphery of the wire, in such a way, the wire is more stable held in the groove 131. It is understood that the extension direction of the groove 131 is in the width direction of the connector, and there are two grooves 131.

Referring to FIG. 7, FIG. 8, FIG. 9 and FIG. 10, in this embodiment, the elastic piece 140 comprises a V-shaped body 141, the body 141 comprises a first connection portion and a second connection portion which are arranged in included angles, the first connection portion of the body 141 is compressed in the inner bottom surface of the first shell 100 or the second shell 120, the body 141 is provided with two opposite connection arms 142 and an extension portion 143 located between the two connection arms 142, namely, the extension portion 143 is arranged at one end of the second connection portion of the body 141 far away from the first connection portion, the connection arms 142 are abutted against the flip caps 150, the extension portion 143 is matched with the grooves 131 so that at least partial wires are compressed in the grooves 131 through the extension portion 143. When the wire is held, the extension portion 143 of the body 141 extends into the grooves 131, thereby facilitating the wire is stably compressed in the grooves 131.

Referring to FIG. 4, in this embodiment, the first shell 100 is provided with a first fixation plate 102 extending toward the second shell 120, the first fixation plate 102 is provided with a first clamp portion 1021, the second shell 120 is provided with a second fixation plate 122 extending toward the first shell 100, the second fixation plate 122 is provided with a second clamp portion 1221, the top of the middle body 110 is respectively provided with a first clamp hole 111 matched with the first clamp portion 1021 and a second clamp hole 112 matched with the second clamp portion 1221. By respectively clamping the first shell 100 and the second shell 120 with the middle body 110, the assembling and disassembling of the straight through type connector capable of repeatedly pulling caps at both ends are facilitated, and assembling efficiency is improved.

The first clamp portion 1021 and the second clamp portion 1221 both comprise inclined surfaces. In a direction from top to bottom, the distance between the inclined surface of the first clamp portion 1021 and the inclined surface of the second clamp portion 1221 is gradually reduced. Since the first clamp portion 1021 and the second clamp portion 1221 both comprise inclined surfaces, arrangement of the inclined surfaces can facilitate the first clamp portion 1021 to enter the first clamp hole 111 and the second clamp portion 1221 to enter the second clamp hole 112. Further, the first clamp portion 1021 and the second clamp portion 1221 can be configured as a triangular prism shape. Correspondingly, the first clamp hole 111 and the second clamp hole 112 can be square holes. When the first clamp portion 1021 and the second clamp portion 1221 correspondingly enter the first clamp hole 111 and the second clamp hole 112, the first clamp portion 1021 is matched with the first clamp hole 111, the second clamp portion 1221 is matched with the first clamp hole 112, thereby improving the structure stability of the straight through type connector capable of repeatedly pulling caps at both ends.

Referring to FIG. 3, in this embodiment, the two sides of the middle body 110 are respectively provided with slots 113, the first fixation plate 102 is inserted into one of the slots 113, and the second fixation plate 122 is inserted into the other slot 113. It can be understood that the first clamp hole 111 is communicated with one of the slots 113, and the second clamp hole 112 is communicated with the other slot 113.

Referring to FIG. 4, in this embodiment, the bottom of the middle body 110 is also provided with the first clamp hole 111 and the second clamp hole 112, the bottom side of the first shell 100 is also provided with the first clamp portion 1021, and the bottom side of the second shell 120 is also provided with the second clamp portion 1221. Through respective arrangement of the first clamp hole 111 and the second clamp hole 112 on the upper part and the lower part of the middle body 110, namely, by respectively connecting the upper and lower parts of the first shell 100 and the upper and lower parts of the second shell 120 with the upper and lower parts of the middle body 110, the structure stability of the straight through type connector capable of repeatedly pulling caps at both ends can be enhanced.

Figure 11:
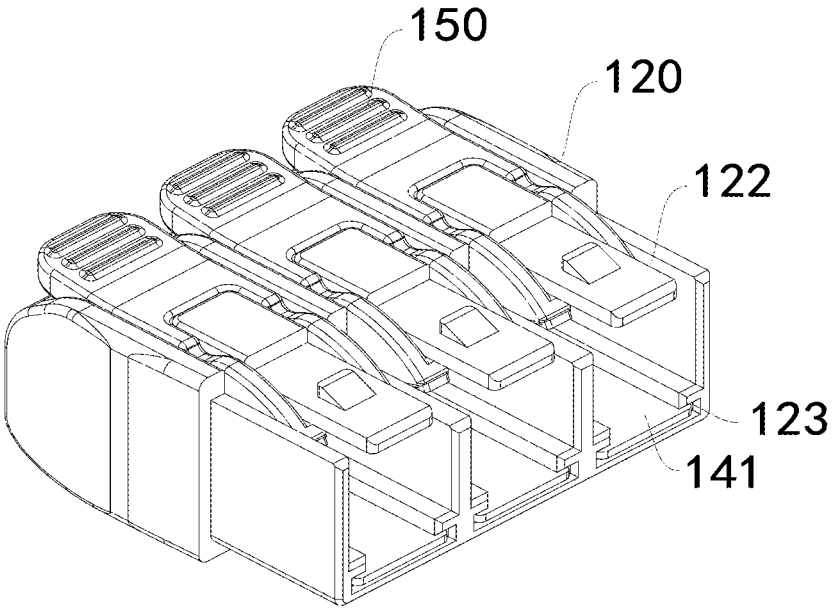
FIG. 11 is a structural diagram of a second shell, a flip cap and an elastic piece according to an embodiment of the disclosure.

Referring FIG. 11, in this embodiment, limit grooves 123 are respectively formed in the first shell 100 and the second shell 120, the limit grooves 123 extend in a horizontal direction, and at least partial elastic pieces 140 are clamped in the limit grooves 123. Through arrangement of the limit grooves 123, the fixation of the elastic pieces 140 relative to the first shell 100 or the second shell 120 can be maintained, in such a way, when the flip caps 150 rotate, the position of the first connection portion of the elastic piece 140 is always maintained unchanged, and only second connection portion is deformed or restores deformation.

The above descriptions are only preferred embodiments of the disclosure but is not intended to limit the disclosure. For those skilled in the art, various modifications and changes can be made in the disclosure. Any modifications, equivalent substitutions, improvements and the like made within the spirit and principle of the disclosure are all included within the protection scope of the disclosure.

I claim:

1. A straight through type connector capable of repeatedly pulling caps at both ends, comprising a first shell having a first jack hole, a middle body, a second shell having a second jack hole, a conductor, two elastic pieces and two flip caps, wherein, the middle body is arranged between the first shell and the second shell and the first shell can be detachably abutted with the second shell, the two flip caps are in one-to-one correspondence and are respectively rotatably arranged in the first shell and the second shell, the conductor penetrates through the middle body and is fixed relative to the middle body, one end of the conductor extends toward the first shell, the other end of the conductor extends toward the second shell, the conductor is located above the two elastic pieces and respectively form a holding space for holding wires together with the two elastic pieces, one of the two elastic pieces is arranged in the first shell and driven by one of the flip caps to be close to or far away from the conductor, the other elastic piece is arranged in the second shell and driven by the other flip cap to be close to or far away from the conductor.

2. The straight through type connector capable of repeatedly pulling caps at both ends according to claim 1, wherein, the bottom side of the conductor is provided with grooves, at least partial elastic pieces upwardly extend into the grooves to compress at least partial wires in the grooves.

3. The straight through type connector capable of repeatedly pulling caps at both ends according to claim 2, wherein, the elastic piece comprises a V-shaped body, one side of the body is compressed in the inner bottom surface of the first shell or the second shell, the body is provided with two opposite connection arms and an extension portion located between the two opposite connection arms, the connection arms are abutted against the flip caps, the extension portion fits with the grooves to compress the at least partial wires into the grooves through the extension portion.

4. The straight through type connector capable of repeatedly pulling caps at both ends according to claim 2, wherein, the vertical cross section of the groove is of a trapezoid shape.

5. The straight through type connector capable of repeatedly pulling caps at both ends according to claim 1, wherein, the first shell is provided with a first fixation plate extending toward the second shell, the first fixation plate is provided with a first clamp portion, the second shell is provided with a second fixation plate extending toward the first shell, the second fixation plate is provided with a second clamp portion, the top of the middle body is respectively provided with a first clamp hole matched with the first clamp portion and a second clamp hole matched with the second clamp portion.

6. The straight through type connector capable of repeatedly pulling caps at both ends according to claim 5, wherein, the first clamp portion and the second clamp portion both comprises inclined surfaces, and in a direction from top to bottom, the distance between the inclined surface of the first clamp portion and the inclined surface of the second clamp portion is gradually reduced.

7. The straight through type connector capable of repeatedly pulling caps at both ends according to claim 5, wherein, the two sides of the middle body are respectively provided with slots, the first fixation plate is inserted into one of the slots, and the second fixation plate is inserted into the other slot.

8. The straight through type connector capable of repeatedly pulling caps at both ends according to claim 5, wherein, the bottom of the middle body is also provided with the first clamp hole and the second clamp hole, the bottom side of the first shell is also provided with the first clamp portion, and the bottom side of the second shell is also provided with the second clamp portion.

9. The straight through type connector capable of repeatedly pulling caps at both ends according to claim 1, wherein, limit grooves are respectively formed in the first shell and the second shell, the limit grooves extends in a horizontal direction, and at least partial elastic pieces are clamped in the limit grooves.

* * * * *